US008215085B2

(12) United States Patent
Phung et al.

(10) Patent No.: US 8,215,085 B2
(45) Date of Patent: Jul. 10, 2012

(54) METHODS OF PREPARING WEB MATERIAL FOR PRODUCTION OF RECEPTACLES FOR FOOD OR OTHER PRODUCTS

(75) Inventors: Quang Tien Phung, London (GB); Fernanda Costa Pereira, Middlesex (GB); Julian David Kyrle Money, Richmond (GB)

(73) Assignee: Rapid Action Packaging Limited, Mortlake, London (GB)

( * ) Notice: Subject to any disclaimer, the term of this patent is extended or adjusted under 35 U.S.C. 154(b) by 438 days.

(21) Appl. No.: 12/439,123

(22) PCT Filed: Aug. 29, 2007

(86) PCT No.: PCT/GB2007/003273

§ 371 (c)(1),
(2), (4) Date: Feb. 26, 2009

(87) PCT Pub. No.: WO2008/025982

PCT Pub. Date: Mar. 6, 2008

(65) Prior Publication Data

US 2010/0019020 A1 Jan. 28, 2010

(30) Foreign Application Priority Data

Aug. 29, 2006 (GB) ..... 0616995.7

(51) Int. Cl.
*B31B 17/00* (2006.01)

(52) U.S. Cl. ..... 53/95; 493/61; 493/77; 493/160

(58) Field of Classification Search ..... 53/456; 493/61, 62, 77, 95, 97, 160–162, 396–398, 493/401

See application file for complete search history.

(56) References Cited

U.S. PATENT DOCUMENTS

| | | | |
|---|---|---|---|
| 662,969 | A | 12/1900 | Roth |
| 1,221,785 | A | 4/1917 | Williams |
| 1,664,111 | A | 3/1928 | Johnson |
| 1,758,585 | A | 5/1928 | Riegel |
| 1,933,643 | A | 11/1933 | Tanner |

(Continued)

FOREIGN PATENT DOCUMENTS

DE 3702673 A1 * 11/1987

(Continued)

OTHER PUBLICATIONS

International Search Report; PCT/GB2007/003273; Dec. 10, 2007; J. Serrano Galarraga.

(Continued)

*Primary Examiner* — Hemant M Desai
(74) *Attorney, Agent, or Firm* — Fish & Richardson P.C.

(57) ABSTRACT

The disclosure relates to a method of preparing a web of flexible material for production of receptacles for packaging. The method comprises the steps of feeding a web of flexible material past a succession of stations in which operations are carried out on the web including defining blanks for receptacles having walls and tabs by creating fold lines in the web, and then laminating a film of heat-sealable plastics materials to a face of the web of the flexible material. The film of heat-sealable plastics provides a heat-sealable surface on the web for bonding tabs of each blank together to form seams between adjacent walls whereby the blanks, when severed from the web, can be erected to form receptacles having openings to receive items to be packaged.

18 Claims, 17 Drawing Sheets

U.S. PATENT DOCUMENTS

| | | | | |
|---|---|---|---|---|
| 2,107,946 | A | 2/1938 | Inman | |
| 2,220,110 | A | 11/1940 | Layton | |
| 2,349,589 | A | 5/1944 | Harrington | |
| 2,701,090 | A | 2/1955 | Buttery | |
| 2,913,161 | A | 11/1959 | Travis | |
| 3,006,527 | A | 10/1961 | Lofquist, Jr. | |
| 3,082,583 | A * | 3/1963 | Larson et al. | 53/451 |
| 3,118,533 | A | 1/1964 | Curtis | |
| 3,142,430 | A | 7/1964 | Meyers | |
| 3,250,454 | A | 5/1966 | Steiger | |
| 3,357,631 | A | 12/1967 | Aid et al. | |
| 3,428,235 | A | 2/1969 | Randazzo | |
| 4,183,458 | A | 1/1980 | Meyers | |
| 4,253,601 | A | 3/1981 | Kossoff | |
| 4,312,451 | A | 1/1982 | Forbes, Jr. | |
| 4,313,542 | A | 2/1982 | Roberts | |
| 4,432,489 | A | 2/1984 | Cote | |
| 4,477,014 | A | 10/1984 | Brandenburger | |
| 4,930,639 | A | 6/1990 | Rigby | |
| 5,040,685 | A * | 8/1991 | Focke et al. | 229/87.05 |
| 5,325,960 | A | 7/1994 | Sims | |
| 5,326,022 | A | 7/1994 | Green | |
| 5,330,099 | A | 7/1994 | Beales et al. | |
| 5,375,713 | A | 12/1994 | Horvat et al. | |
| 5,383,596 | A | 1/1995 | Gulliver et al. | |
| 6,068,583 | A * | 5/2000 | Sigl | 493/60 |
| 6,332,488 | B1 * | 12/2001 | Walsh | 156/516 |
| 6,360,941 | B1 | 3/2002 | Larsson | |
| 6,431,365 | B1 | 8/2002 | Money | |
| 6,695,202 | B2 | 2/2004 | Miess | |
| 7,143,930 | B2 | 12/2006 | Money et al. | |
| 2010/0016137 | A1 * | 1/2010 | Benedetti et al. | 493/162 |
| 2010/0127054 | A1 * | 5/2010 | Goldman et al. | 229/116 |

FOREIGN PATENT DOCUMENTS

| | | |
|---|---|---|
| DE | 29903316 | 5/1999 |
| EP | 1 032 531 | 9/2000 |
| GB | 1019065 | 2/1966 |
| GB | 1313950 | 4/1973 |
| GB | 2043595 | 10/1980 |
| GB | 2221449 | 2/1990 |
| GB | 2349634 | 11/2000 |
| GB | 2386112 | 9/2003 |
| GB | 2 397 573 | 7/2004 |
| WO | WO 99/25618 | 5/1999 |
| WO | WO 02/34629 | 5/2002 |

OTHER PUBLICATIONS

Sprinter ES-S Lidsealing Machine; Sprinter System AB, Halmstad, Sweden.

Paperboard Reference Manual; Iggesund Paperboard AB; 1993.

International Search Report; PCT/GB03/05414; H. Segerer; Mar. 24, 2004.

International Search Report; PCT/GB98/03467; M. Vantomme; Feb. 10, 1999.

* cited by examiner

METHODS OF PREPARING WEB MATERIAL FOR PRODUCTION OF RECEPTACLES FOR FOOD OR OTHER PRODUCTS

This application is a 371 of PCT International Application No. PCT/GB07/03273, filed Aug. 29, 2007, which claims priority to United Kingdom Application No. 06 16995.7, filed Aug. 29, 2006, the contents of such applications being incorporated by reference herein.

FIELD

This invention relates to methods of preparing web material for production of receptacles for food or other products and also to receptacles per se.

BACKGROUND

Our EP-B-1032531 discloses a container for foodstuff formed from a one piece blank of card and having isosceles triangular shaped end walls connected by quadrilateral side walls to form a triangular prism shaped container, one side wall of the container being hinged along the base of one of the end walls to provide a lid for the container, with a window in the lid to permit the contents of the container to be viewed. Blanks for forming the containers are preformed with fold lines and windows. Selected walls of the blanks have tabs which are glued to the inside faces of adjacent walls to form prism shaped containers. Fold lines are formed in the triangular walls of the container and lid to enable the container to be folded flat.

Our UK-A-2397573 discloses a carton for a diagonally cut sandwich or like foodstuff formed from a blank of card and having triangular end walls connected by quadrilateral side walls to form a triangular prism-shaped container. One side wall of the container is hinged to one of the end walls of the container to provide an opening for insertion/removal of foodstuff and to form a lid for closing the opening. The edges of the opening have out-turned flanges, and the periphery of the lid overlies the out-turned flanges encircling the opening when the lid is in the closed position whereby the lid can be bonded to the flanges to seal the contents of the carton.

SUMMARY

It is an object of the invention to provide a method of forming receptacles for food and other products and a receptacle per se which can be produced more efficiently.

This invention provides a method of preparing a web of flexible material for production of receptacles for food and the like, the method comprising the steps of feeding a web of flexible material past a succession of stations in which operations are carried out on the web including defining blanks for receptacles having walls and tabs by creating fold lines in the web and then laminating a film of heat-sealable plastics materials to one face of the web of the flexible material to provide a heat-sealable surface for bonding the tabs of each blank together to form seams between adjacent walls whereby the blanks, when severed from the web, can be erected to form receptacles.

In one method according to the invention the fold lines may be formed by at least partially cutting through or scoring the web of flexible material. Alternatively the fold lines may be defined by continuous partial cuts in the web or by skip cut or discontinuous cut lines through the web.

Preferably the seams formed by the bonded tabs are external to the receptacle.

It is a further preferred that a portion of at least one wall of each blank delineated in the web is cut out to form a window for the receptacle to be formed from the blank and over which the heat-sealable plastic extends.

In the latter method the blank may include a wall which provides a lid for the receptacle and the window may be formed in the lid.

In any of the above methods the laminated web may be formed onto a reel for subsequent processing into containers.

In a preferred form of the method each blank delineated on the web has a centre line about which it is symmetrical with respective walls, part walls and tabs disposed on either side of the centre line and the laminated web is folded about the centre line of the blanks to bring the surfaces of the plastic material including the tabs on either side of the centre line together and the tabs are then heat-sealed together to form the seams in the blank which allow the blank to be erected to form a receptacle.

In the latter method the folded web may be cut round the folded profile of each blank to separate the blanks in folded form from the web for subsequent erection on traditional or custom built flow wrapping lines.

In any of the above methods each blank delineated on the web may have triangular side walls and rectangular end walls to enable a prism shaped receptacle to be erected from the blank.

In the latter case one of the end walls may be hinged to another wall to form an openable lid to the receptacle.

More specifically each blank may include a first complete triangular side wall having end walls hinged along each edge thereof and triangular half walls hinged to respective end walls with tabs on the respective half walls and adjacent end walls which, when the blank is folded can be heat-sealed together to form seams between the respective end walls of the half walls to form a second complete triangular wall in the erected receptacle.

Furthermore said first triangular wall of the blank delineated on the web may be an isosceles triangle having an included angle which is a right angle or thereabouts, the triangle being aligned on the web with a centre line which bisects said right angle extending lengthwise of the web, the base of the triangle having a quadrilateral end wall connected by a fold line thereto through which said centre line passes and further end walls being connected by fold lines to the sides of the triangle, the half walls which make up the second triangular wall be located on the sides of the end walls opposite the first triangular wall and the further end walls and half walls having at their adjacent edges which can be heat-sealed together to form seams which support the walls when the carton is erected from the blanks.

In any of the above methods the web of flexible material may be a web of paper, card or carton board. The paper weight may be in the range 20 gsm to 250 gsm and possibly up to 500 gsm. Preferably paper in the range 80 gsm to 200 gsm is used. Most food grade papers can be used including uncoated, single coated, double coated and natural coloured papers. The film of transparent plastics with which the paper is laminated may be any suitable heat sealable film including PP, Polyester, PLA and Polyethylene.

The film may have an anti-misting coating to prevent fogging of the window. One particularly suitable material for the receptacle consists of a 170 gsm uncoated or double coated bleached paper and a 20 micron PLA with an anti-misting coating.

BRIEF DESCRIPTION OF THE DRAWINGS

The following is a description of some specific embodiments of the invention, reference being made to the accompanying drawings in which.

DETAILED DESCRIPTION

Figure 1:
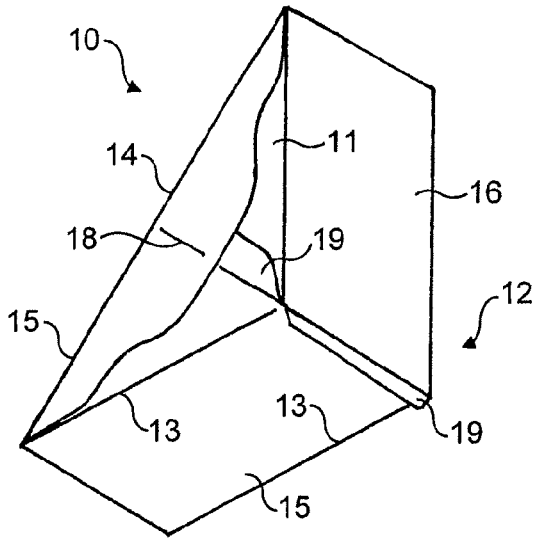
FIG. 1 is a perspective view looking at the back of a triangular prism shaped non-hermetically sealed sandwich pack shown with a front lid closed.
Figure 2:
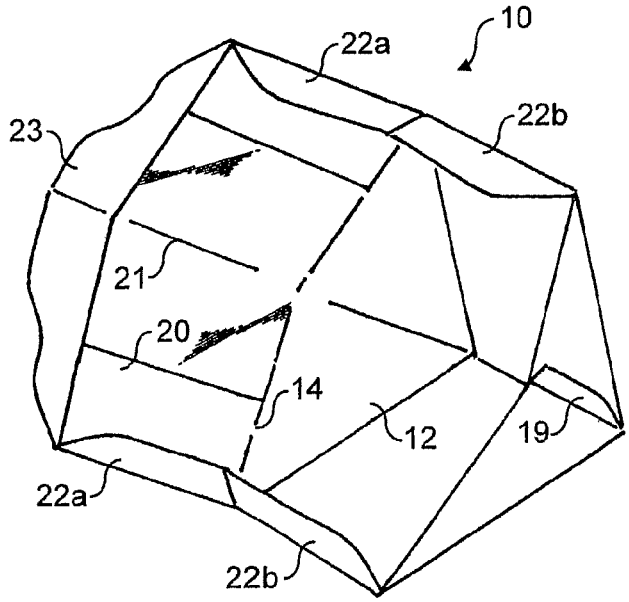
FIG. 2 is a front view of the pack with the lid open and the sides bowed outwardly to receive a sandwich stack.
Figure 3:
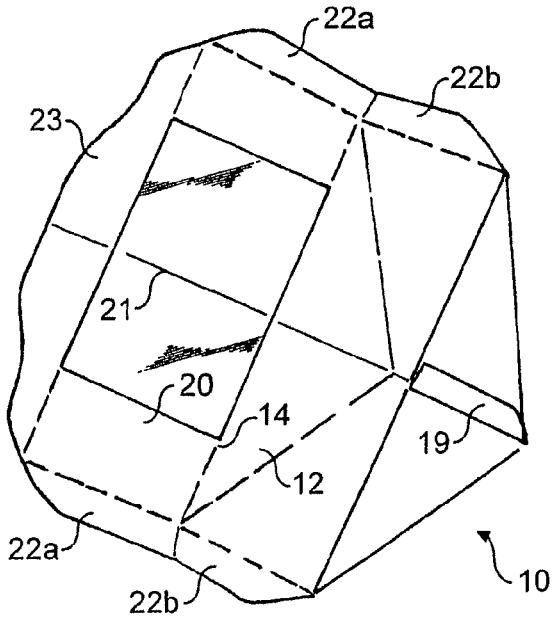
FIG. 3 is a similar view to FIG. 2 with the pack sides straight.

FIGS. 1 to 3 show a completed pack produced by the method of the invention and will be described firstly followed by a description of the blank produced by the method of the invention and finally the method of producing the blank will be described.

Referring therefore to FIGS. 1 to 3, there is shown a pack indicated generally at 10 intended for holding a food item or items and in particular for holding a cut sandwich stack for display at a retail outlet. The pack is of prism shaped form having an isosceles triangle shaped cross-section and comprises triangular side walls 11 and 12 which are of isosceles triangular form 13 having equal length and a hypotenuse 14. The included angle between the equal lengths side walls of each triangular side wall is approximately 90°.

The triangular side walls 11 and 12 are connected by generally rectangular bottom and end walls 15,16 which at the corner of the pack have out-turned flanges 17 which are bonded together to form a seam at the apex of the pack as described later. The end walls may taper slightly towards the apex if the pack is to be machine filled to enable the pack to be supported in a trough shaped holder and readily removed from the holder.

The triangular side wall 11 of the pack is formed in two parts 11*a*, 11*b* divided at the perpendicular bisector of the triangle 18 to the hypotenuse 14 and which are also of isosceles triangular form. The respective triangular parts have out-turned flanges 19 which are bonded together to form a seam as described later. The other triangular side wall 12 of the pack is formed in one piece and, as best seen in FIGS. 2 and 3, has a lid 20 for the pack hinged to the hypotenuse edge 14 of the wall 12. The lid 20 has a large rectangular window 21 to enable the contents of the pack to be viewed.

To avoid the cut edge of the sandwich stack from contacting and possibly smearing the window, the lid, together with the walls 15 and 16 of the stack have pairs of integral inturned flanges 22*a*, 22*b* which fold inwardly on closing the lid to overlie one another and overlie the end of the stack of sandwiches to be placed in the body of the pack 10 to hold the cut edge of the sandwiches away from the window 21.

Figure 4:
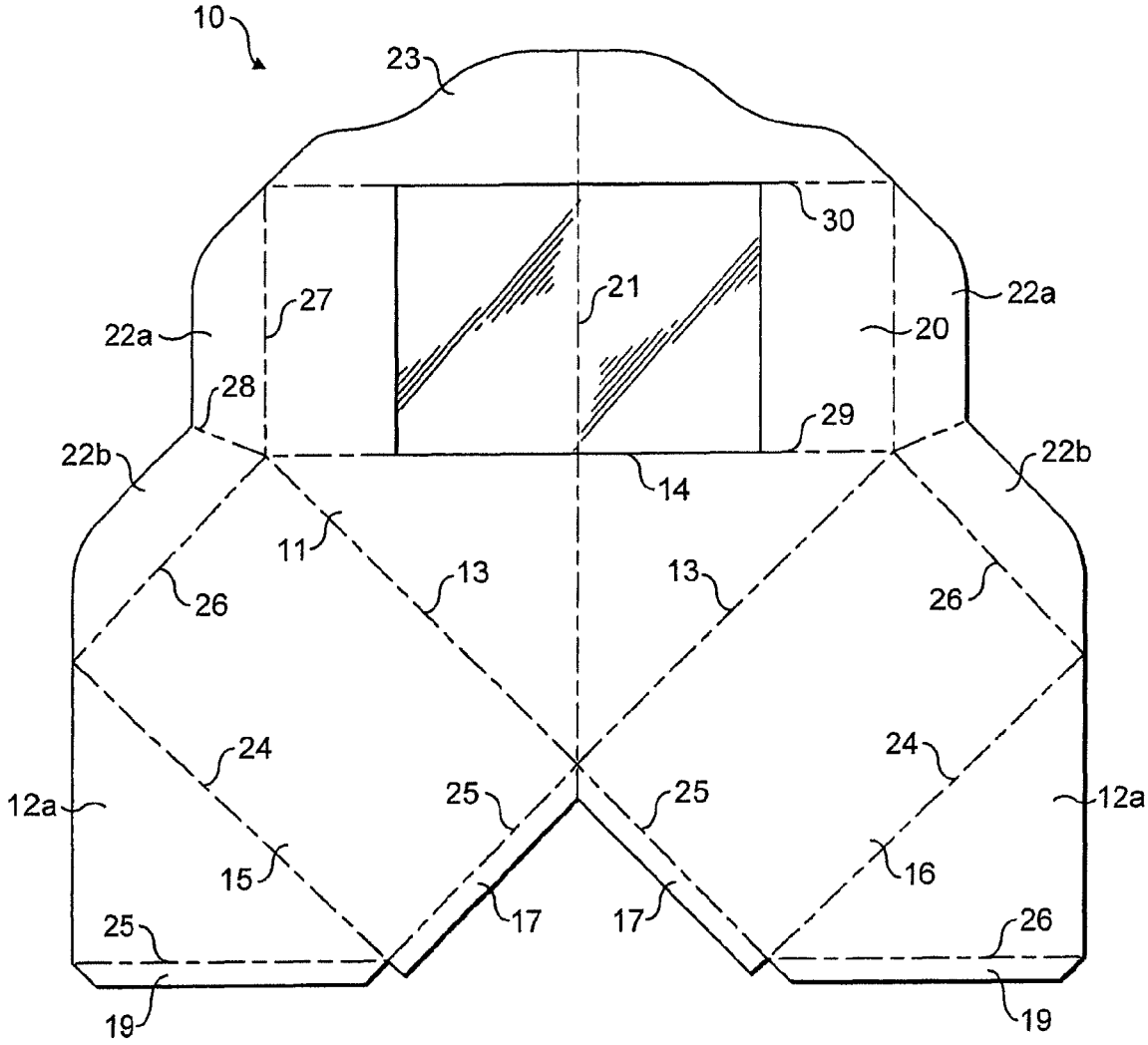
FIG. 4 shows the blank from which the pack is formed.

The blank for the carton 10 which is illustrated in FIG. 4 of the drawings will now be described. The triangular side wall 11, the two parts of the triangular side wall 12, the bottom wall 15, back wall 16 and front wall provided by the lid 20 can all be readily seen. Fold lines are formed between the triangular side wall 11 and the bottom and back walls 15 and 16. Similarly fold lines 24 are formed between the triangular parts 12*a* and the bottom and back walls.

Fold lines 25 are formed between the tabs 19 and the bottom and back walls. Fold lines 26 are formed between the tabs 17 and the triangular side wall parts 12*a*. Fold lines 26, 27 are formed between the tabs 22 and the back/bottom walls and lid 20. The lid 20 has a fold line 29 between the lid and the hypotenuse 14 of the triangular side wall 11 and the other side of the lid has a fold line 30 between the lid and the tab 23.

The fold lines may be formed by creasing the paper/card from which the blank is formed or by scoring or cutting part way through the blank or by skip or discontinuous cut lines to enable the folds to be readily created when erecting the carton.

Figure 5:
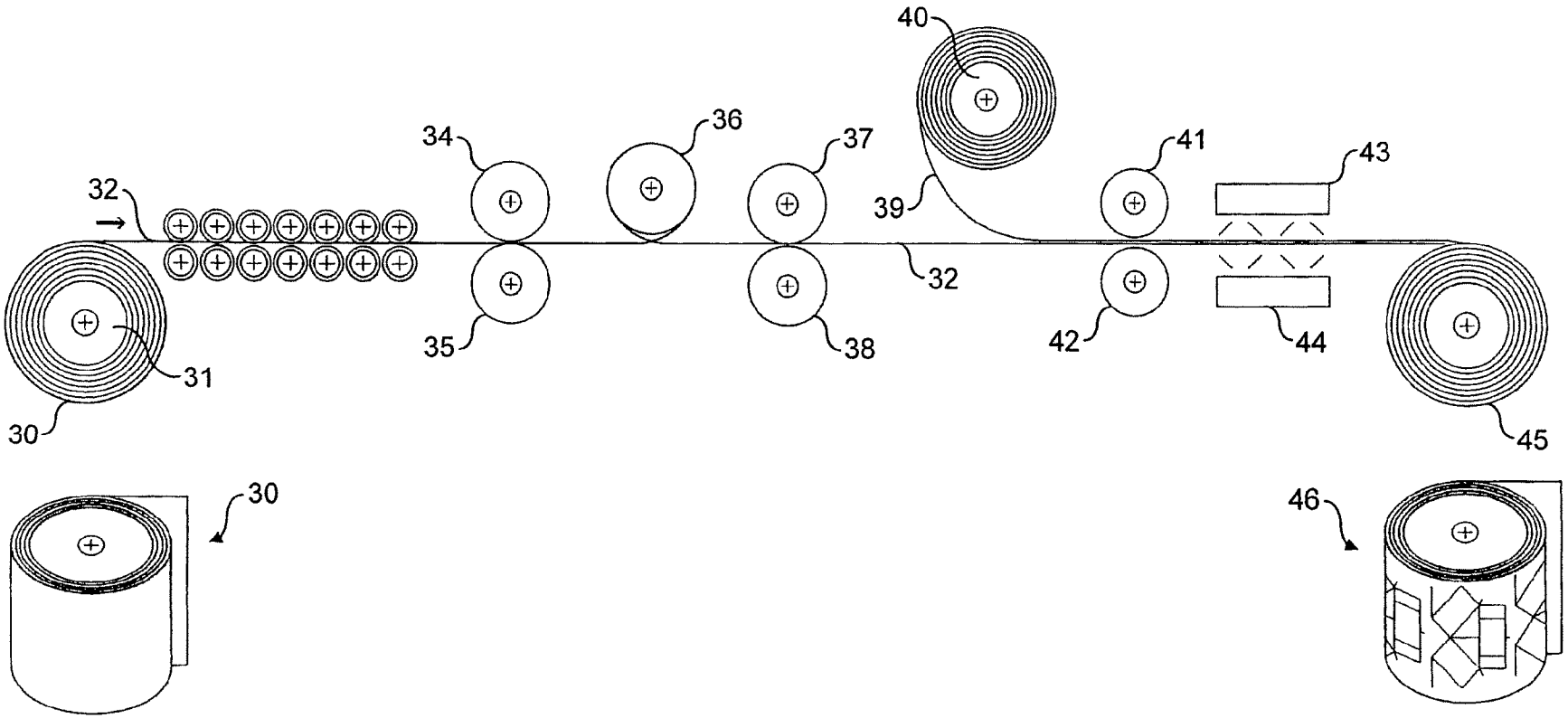
FIG. 5 is a diagrammatic view of the preparation stages of a web from which blanks for the packs are to be subsequently produced.

Reference is now made to FIG. 5 of the drawings which shows the first stage in the production of the blanks from which the packs are to be formed. A reel of a web of material from which the packs are to be formed is indicated at 30. The material may be a relatively heavy grade paper or a soft card. For example a paper weight in the range 20 to 25 gsm may be used although 80 to 200 gsm is preferred. Food grade papers can be used including both coated (single or double-sided), uncoated papers and natural papers are suitable as are recycled papers. The reel is mounted on a roller 31 to enable the web to be unrolled and fed to a plurality of stations where different treatments are carried out on the web.

Blanks are formed in succession along the length of the web with the line of symmetry of each blank extending lengthwise along the middle of the web.

In the first operation the web 32 passes between several (e.g. seven) pairs of upper and lower rollers 33 which apply print colours and varnishes. The upper rollers are print or varnish applying rollers and the lower rollers support the web from below in the region where it is engaged by the upper rollers. Initial upper rollers print text and graphical information on the upper surface of the web and subsequent rollers apply a coating or coatings of varnish to protect the print. The web then passes between upper and lower cutter rollers 34,35 on which there are cutting blades designed to form continuous lines of partial sever or discontinuous lines of full sever through the web where the subsequent blank is to be folded between adjacent walls of the blank or between adjacent tabs and walls of the blank. The cutters on the roller 35 also form the window 21 in the lid 20 by forming a rectangular cut fully through the material of the lid and then removing the rectangular piece within the rectangular cut line to form a window.

The web then passes to a roller 36 and an A-frame web guide (not shown) which is positioned to turn the web over so that the previously upwardly facing printed surface now faces downwardly. The web then passes between a further pair of drive rollers 37,38.

A web of thin plastics transparent film 39 is fed from a roll 40 to the non-printed upper surface of the web 32 to overlie the web. The film is pressed against the upper surface of the web between upper and lower rolls 41 and 42 to laminate the film to the paper web. The rolls are followed by a dryer 43,44 after which the laminated web is rolled onto a reel 45. The transparent film may be polylactic acid (cellulose) or PE (polyethylene—OPP). It will be understood that forming the various lines of cut including those for the window before the laminating of the transparent film to the web avoids the risk of inadvertently slitting the film when cutting the web although it is envisaged that the web could be formed with the cut lines after lamination if accurate cutting can be performed.

Figure 6:
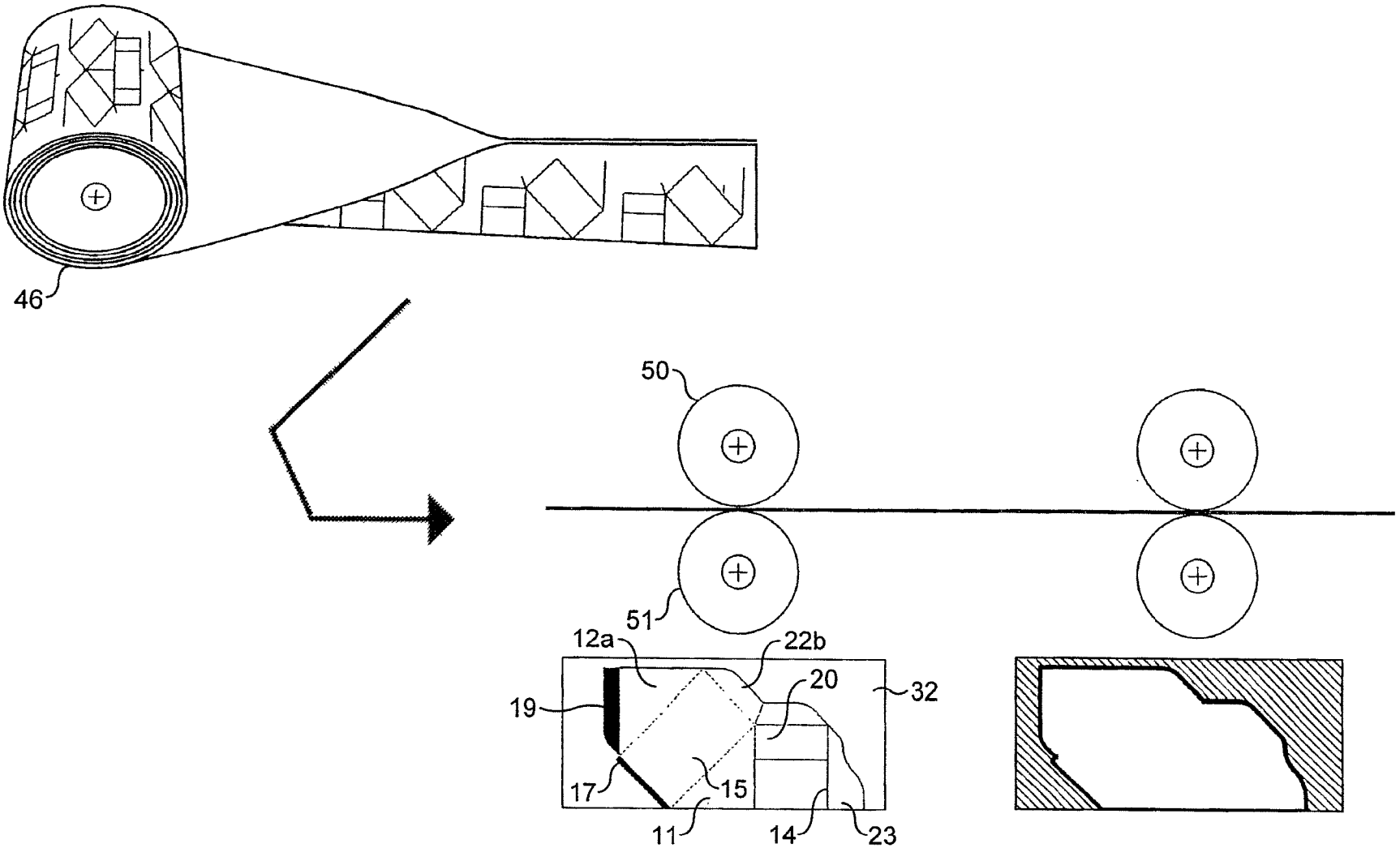
FIG. 6 is a similar view to FIG. 4 showing further steps in the preparation of the web and production of blanks from the web for forming into sandwich packs.

A reel of the thus formed laminated web is illustrated at 46 and the laminated and pre-cut web is transported to a further apparatus for completing the blanks. The reel 46 of web is folded along its centre line by an "A" frame (not shown) bringing the faces of the plastics film into contact with one another. The blanks delineated on the web are thus folded about their respective centre lines (see FIG. 6) bringing the tabs 17 on respective triangular walls 12*a* together and the respective tabs 19 on end walls 15 and 16 together. The folded web is then passed between heated rollers 50,51 which have shaped dies to engage the tab areas 17 and 19 to heat and press the tab areas together to form a heat seal between the tab areas.

The web 32 then passes to a further pair of cutter rollers 55,56 having shaped cutters to cut a folded blank from the web to separate the blank which can be erected into a pack form as shown in FIGS. 2 and 3.

Figure 7:
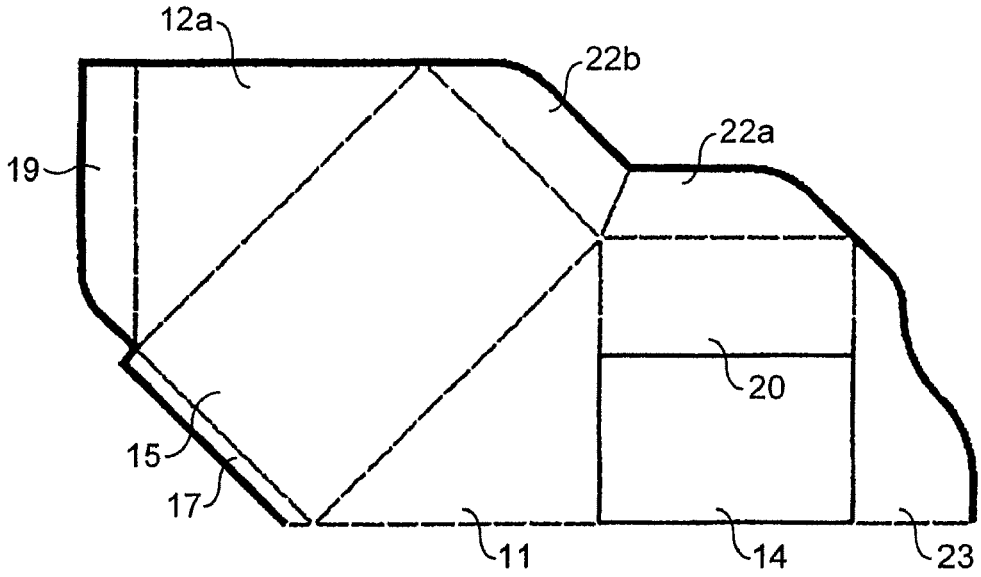
FIG. 7 is an illustration of a folded blank formed by the process.
Figure 8:
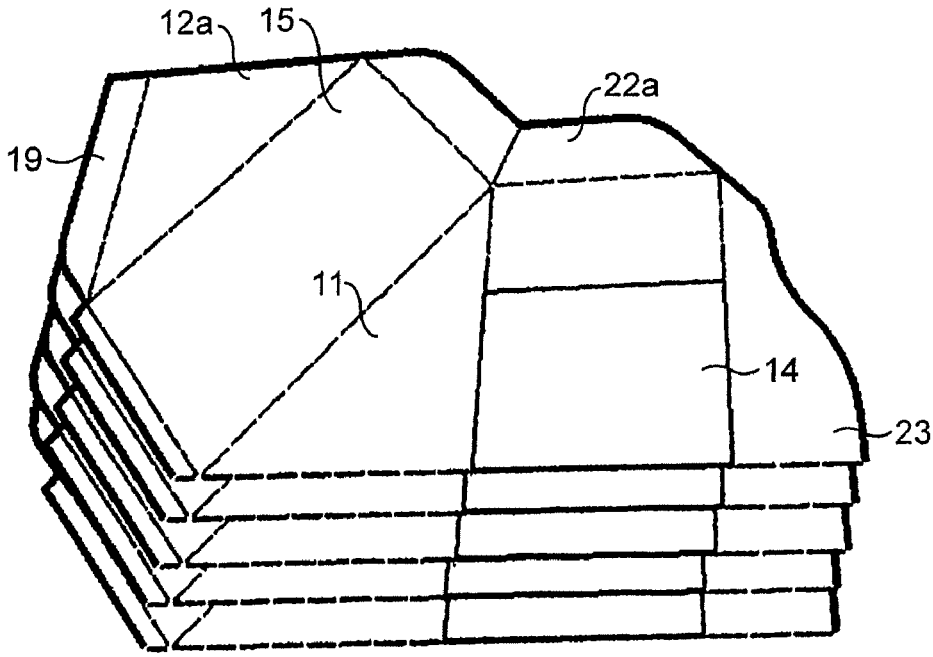
FIG. 8 is an illustration of a stack of carton blanks formed by the process.

An example of a folded blank produced by the method is shown in FIG. 7 and a stack of the folded blanks is shown in FIG. 8.

The folded blanks can readily be unfolded into the condition shown in FIG. 2 with the triangular side walls splayed outwardly to allow easy insertion or withdrawal of a sandwich stack from the carton. When the lid is closed and the flanges 22 are turned in to overlie the ends of the stack, the stack is kept away from the film forming the window in the lid of the carton. A feature of the carton is that the seams 17 and 19 formed between the back and bottom walls and triangular walls of the side 12 lie on the outer side of the carton to form an externally viewable feature of the design.

Suitable heavy grade papers, soft card or carton board materials for forming the receptacles may have weights in the region of 20 to 350 gsm and upwards.

The packs described above have integral lids for closing the packs but the packs are not hermetically sealed. Where the packs are to be used for sandwiches or similar food items, the expected shelf life of the pack is two to three hours. Where a longer shelf life of two to three days is required, the pack must be sealed and preferably flushed with a gas such as a nitrogen based gas mixture. The present invention is equally applicable to sealed pack designs which may, for example, be of the form described and illustrated in our British Patent Publication No. 2397573. Various arrangements of such packs will now be described.

Figure 9:
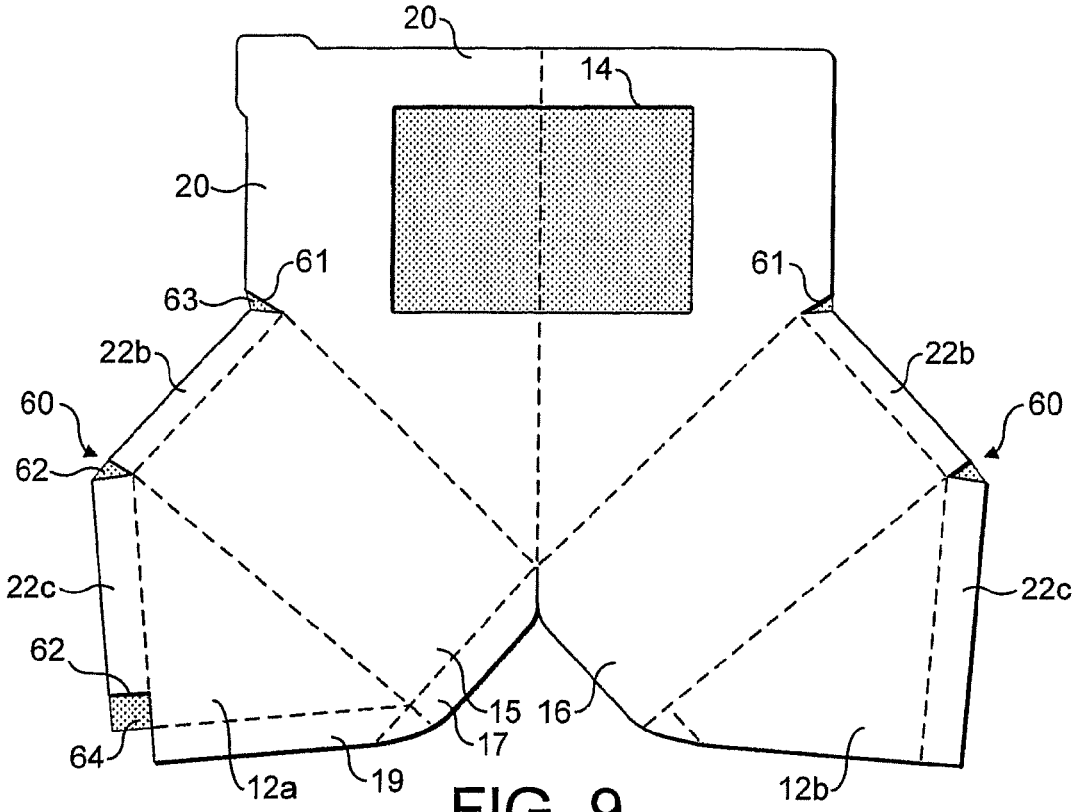
FIGS. 9 to 13 are similar views to FIGS. 1 to 4 of an hermetically sealable sandwich pack.
Figure 10:
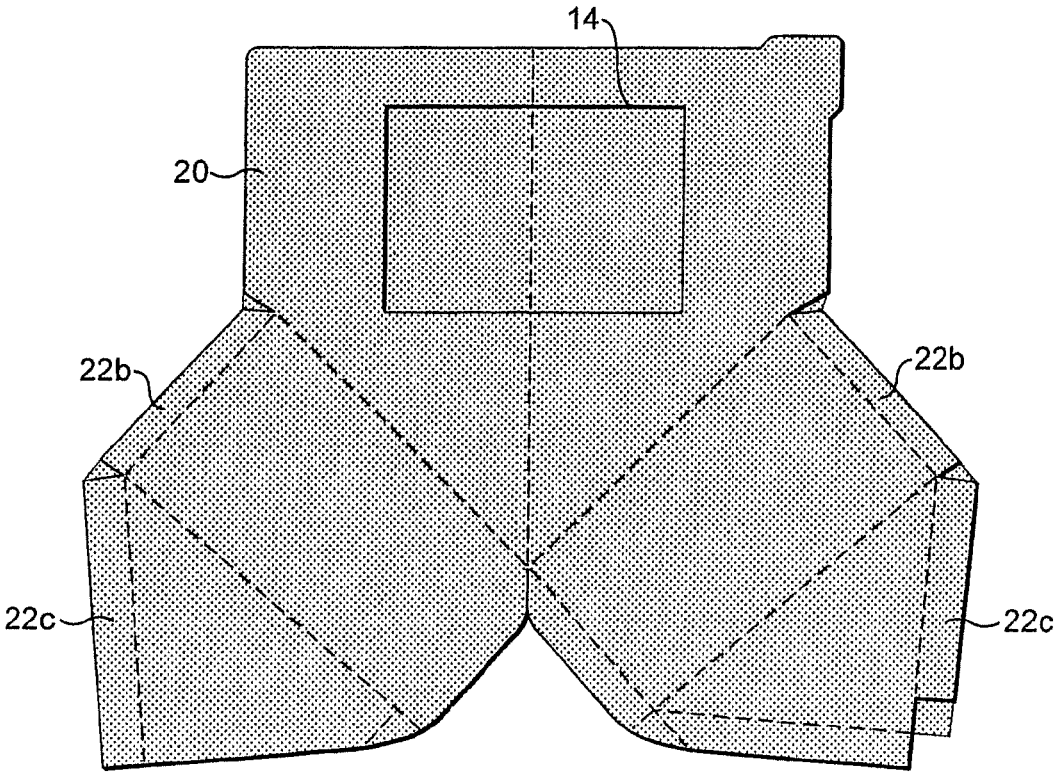
Figure 11:
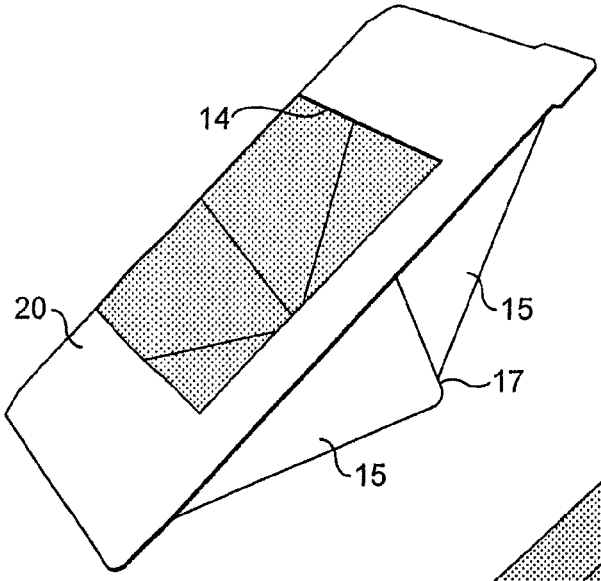
Figure 12:
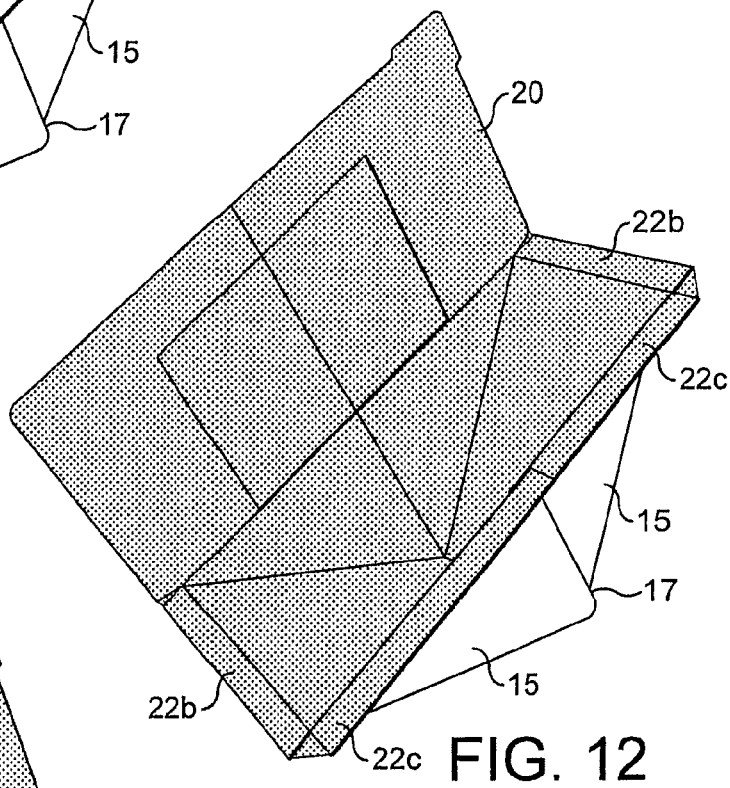
Figure 13:
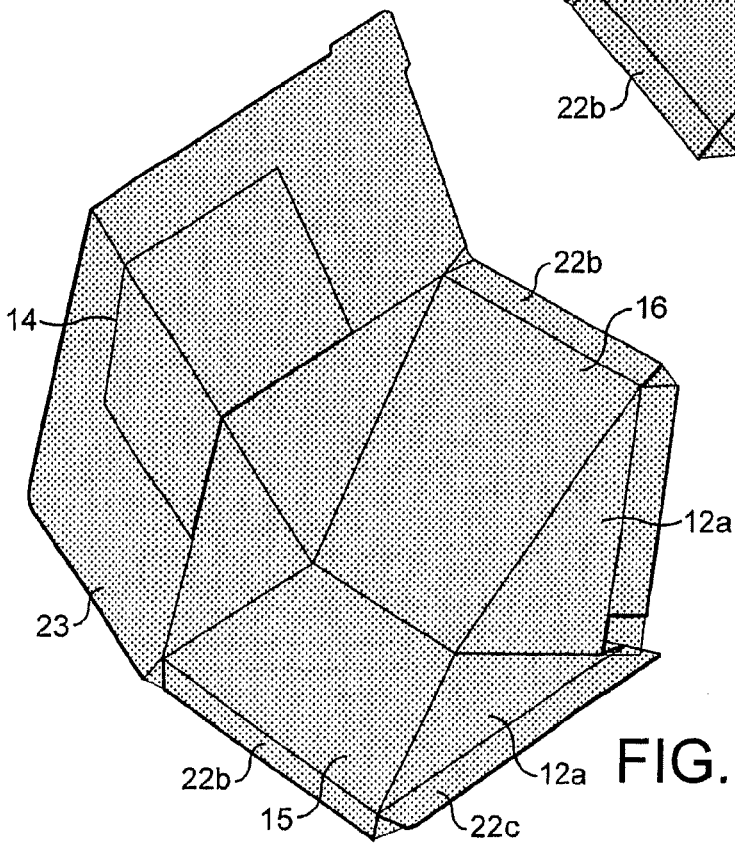

A carton which can be hermetically sealed is shown in FIGS. 11 to 13. Like parts have been allotted the same reference numerals as those used in the previously described embodiments. In this case the opening to the container has out-turned flanges 22*b* along the edges adjacent the lid 20 and out-turned flanges 22*c* along the edge of the opening opposite the lid. The flanges 22*b*, 22*c* are turned outwardly to receive the lid 20 which overlies the flanges to be heat-sealed to the flanges through the plastic laminate coating on the web material which is shown in greyscale. The blank from which the carton is formed is illustrated in FIGS. 9 and 10. As can be seen, the blanks has V shaped notches 60 between the adjacent flanges 22*b* and 22*c*. These are formed in the blank material at the same time as the fold lines and prior to the laminating phase described above. Similar V shaped notches 61 are formed between the lid 20 and flanges 22*b* and finally the flange 22*c* on one of the part walls 22*a* which makes up one of the triangular side walls of the receptacle is cutaway as indicated at 62 so that when the flanges 22*c* on each of the part walls 12*a* and 12*b* are brought together, the flanges 22*c* form a substantially continuous surface to be sealed to the lid 20.

As indicated above, the notches 60, 61 and cutaway 62 are preformed in the web prior to laminating the plastics film. Thus when the film is laminated to the web and the blank cut around the outline of the blank, the film bridges the notches 60 and 61 as indicated at 62 and 63 with a flap 64 being formed where the flange 22*c* is cutaway at 62 to ensure that an hermetic seal is formed between the lid and flanges 22*b*, 22*c* when the carton is closed by heating-sealing the lid to the flanges.

Figure 14:
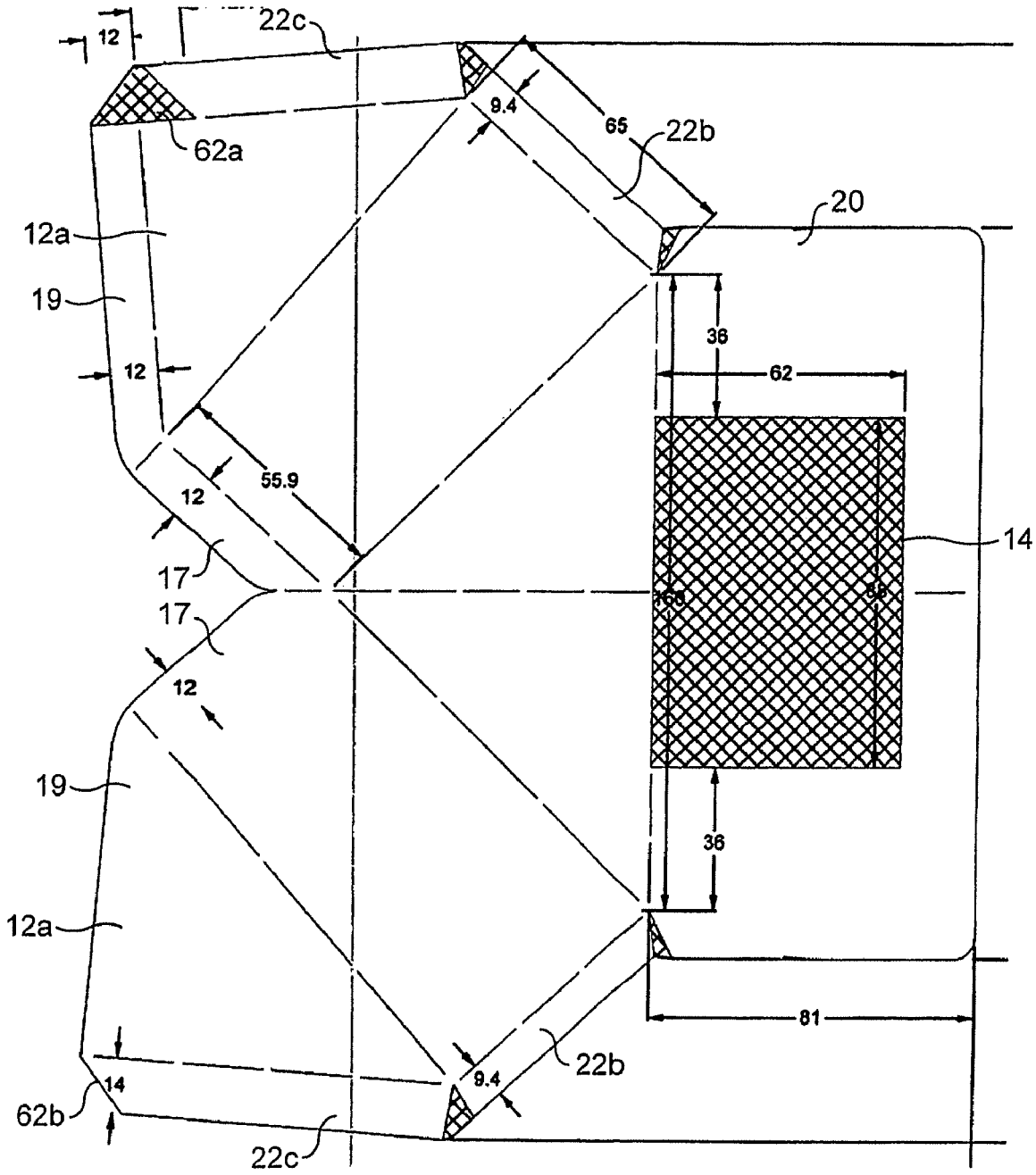
FIGS. 14 to 19 show a number of different blank forms for the pack of FIGS. 9 to 13.

FIG. 14 shows a similar blank except that the cutaway on one of the flanges 22*a* is angled as indicated a 62*a* to align with a similarly angled cutaway 62*b* on the other flange 22*c* to form a continuous surface to seal with the lid.

Figure 15:
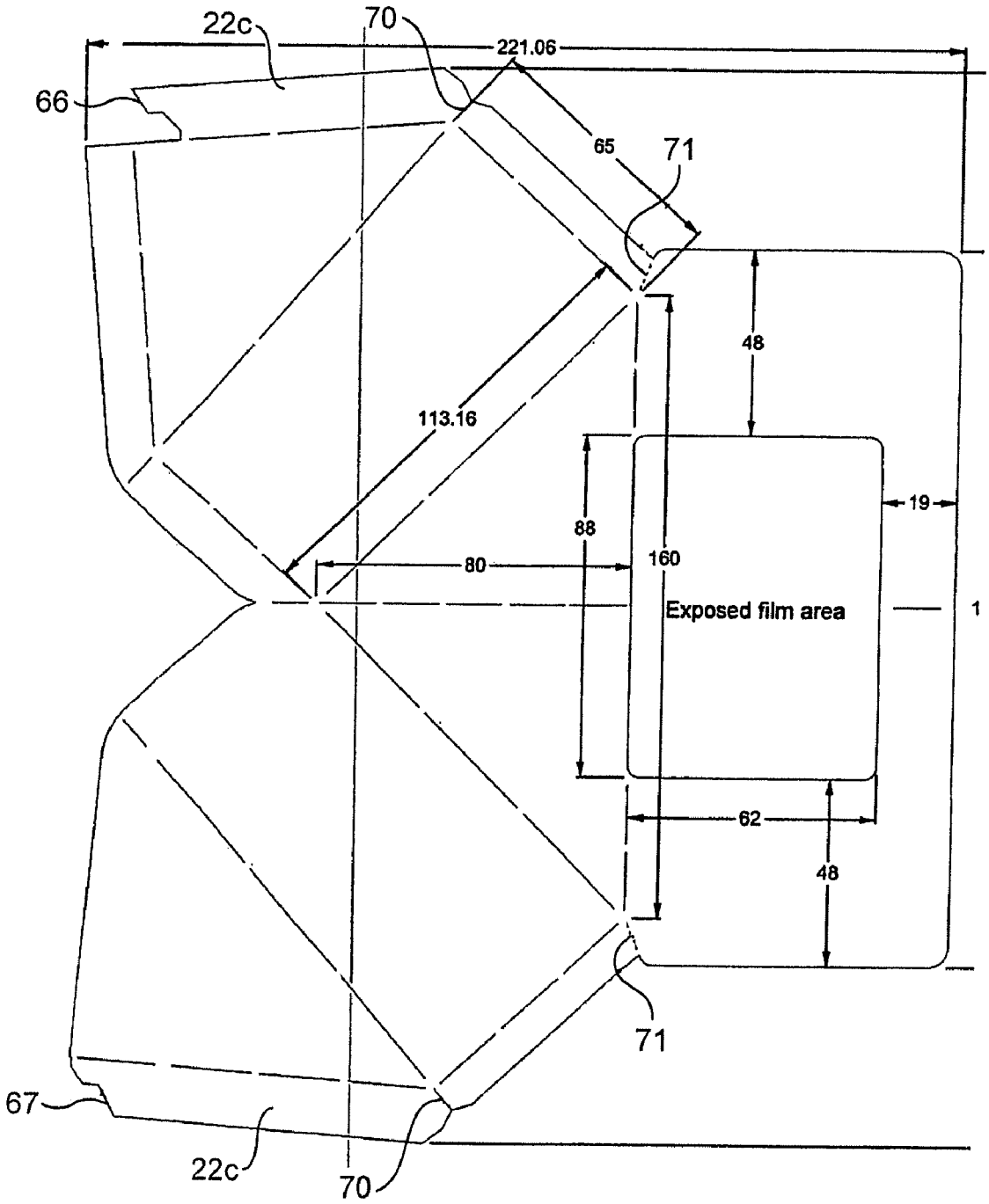

FIG. 15 shows a further variation in which the cutaway in one of the flanges 22*c* has a stepped form as indicated at 66 to align with a similarly stepped form 67 on the other of the flanges 22*c*. A further difference in the blank of FIG. 15 is that the V shaped notches 60, 61 of the blank of FIGS. 9 and 10 are replaced by simple straight cut lines 70, 71.

Figure 16:
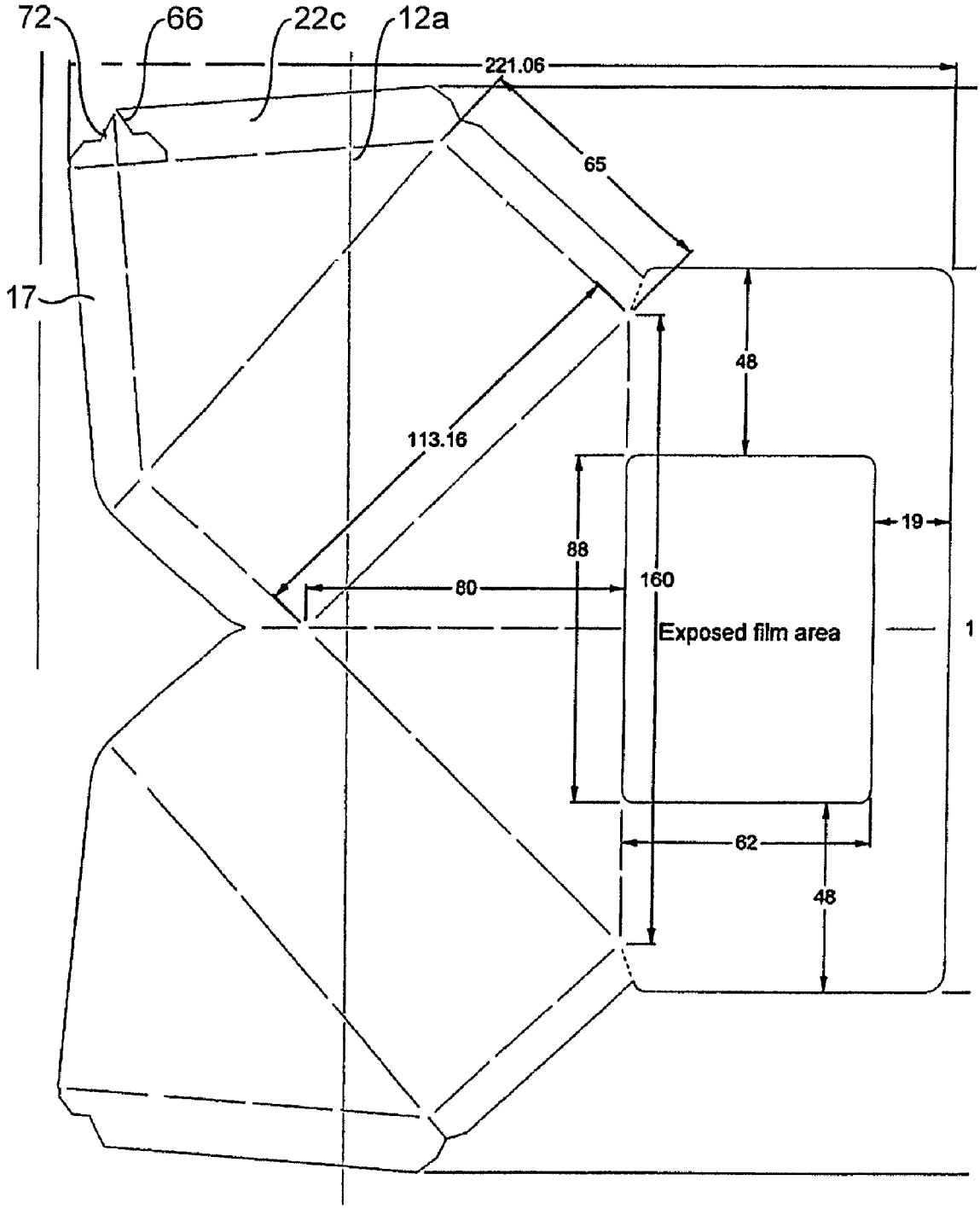

FIG. 16 shows a further variant in the blank form in which the tab 17 on one wall part 12*a* is not cutaway between the flange portions 52*c* but has a projecting element 66 shaped to align with the cutaway end 66 on the adjacent flange 22*c*.

Figure 17:
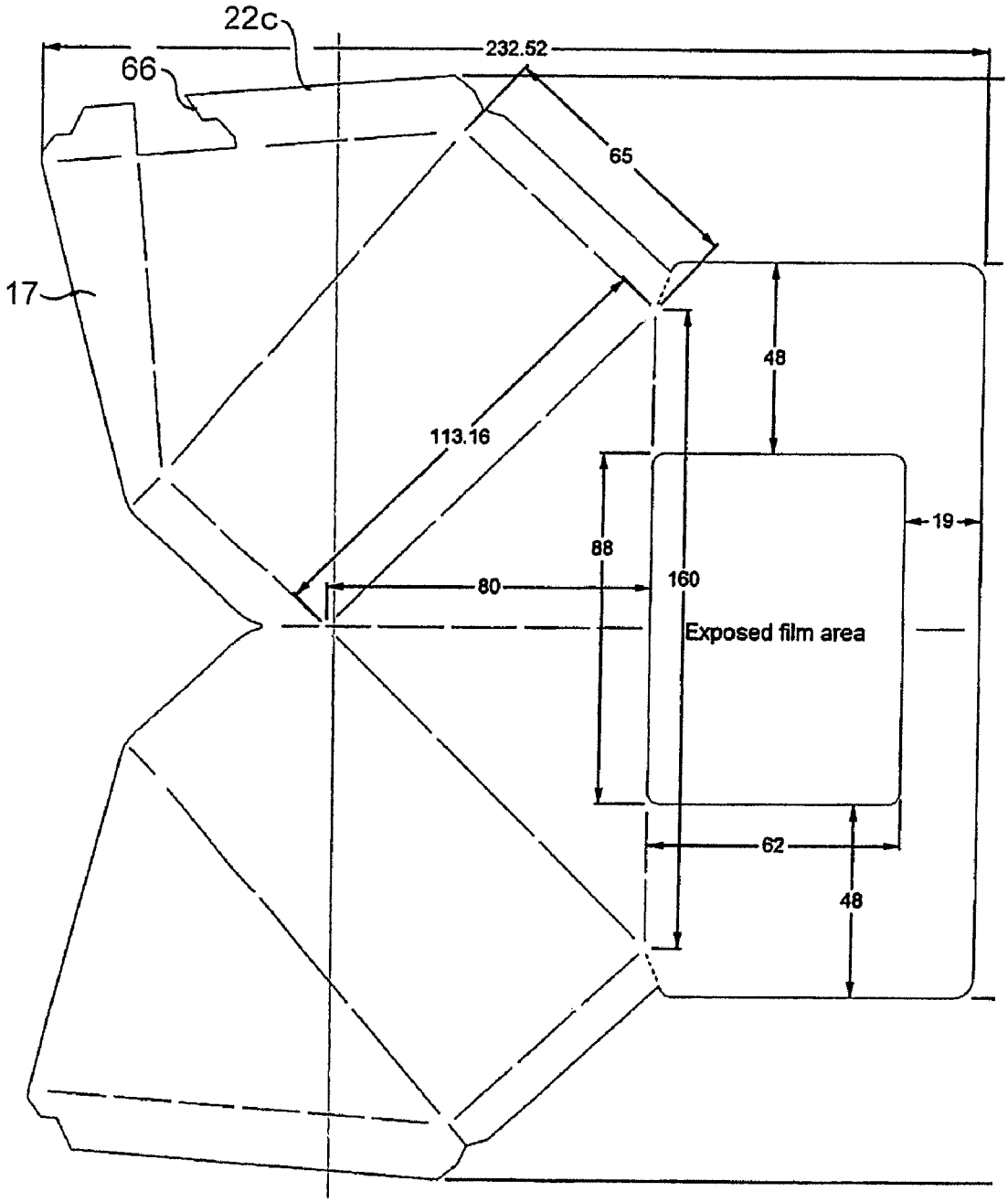

FIG. 17 shows a variant of the arrangement shown in FIG. 16 in which the tabs 17 taper outwardly from the apex of the container to the opening to provide a greater overlap of material where the wall portions 12*a* and 12*b* are joined together to increase the stiffness of the wall.

Figure 18:
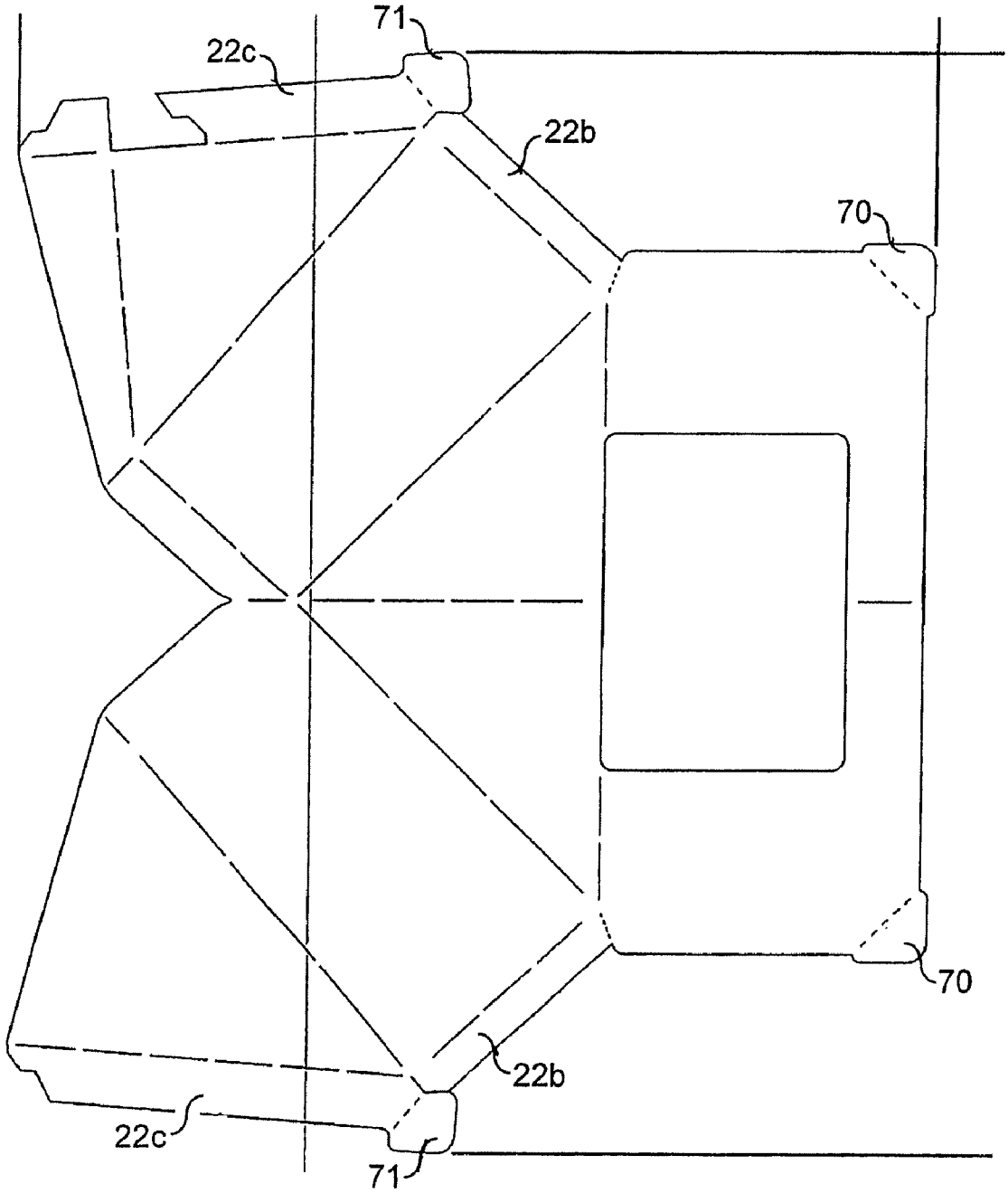

FIG. 18 shows a further variant of the arrangement in which corner tabs 70 are formed on the lid with corresponding corner tabs 71 at the junctions of tabs 22*b* and 22*c* and a peelable transparent heat-sealable plastics material is laminated to the blank. The tabs 70, 71 provide a convenient grip for the lid and container to enable the lid to be peeled open.

Figure 19:
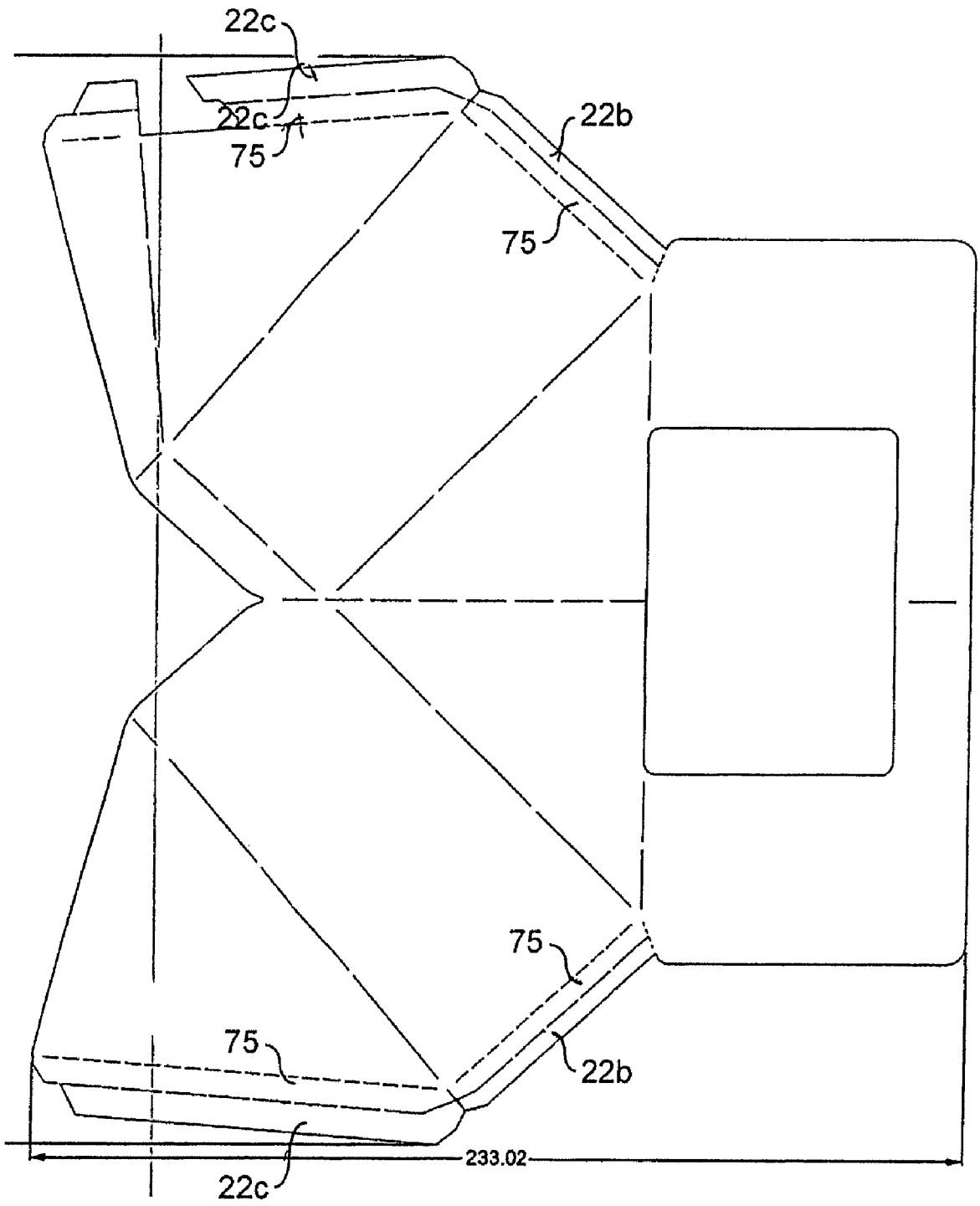

FIG. 19 shows a blank in which the out-turned flanges 22*b* and 22*c* have parallel lines of "Concora" indicated engraved in the surface of the web before the plastics sheet is laminated to the web to enable the lid to be torn open by tearing the lid between the "Concora" lines. The "Concora" arrangement is described and illustrated in greater detail in our British Patent Application No. 2397573.

Figure 20:
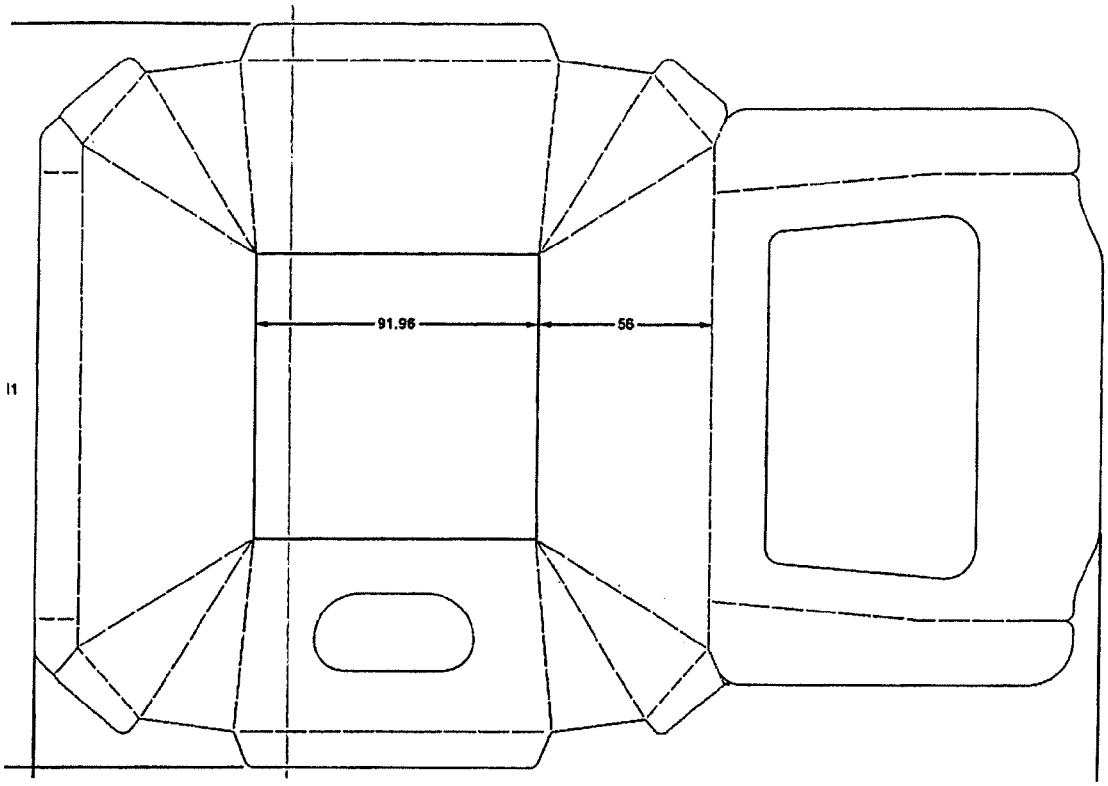
FIGS. 20 and 21 show a blank for a four sided container and the completed container.
Figure 21:
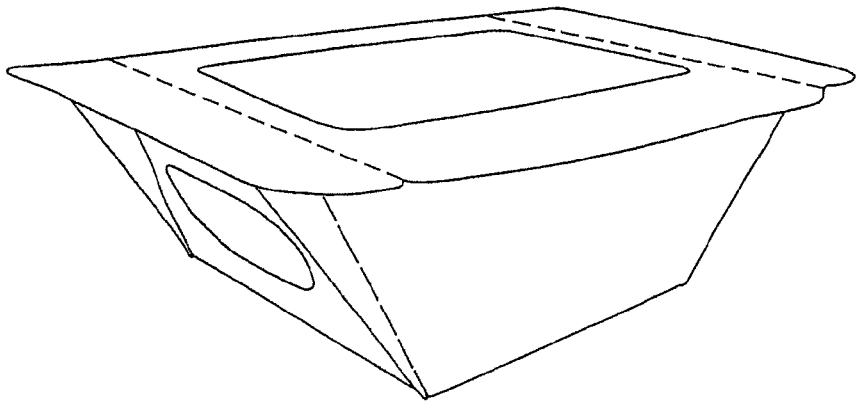

FIGS. 20 and 21 illustrate a four sided receptable formed from a blank in a similar manner to that described above and erected using a tray former.

Figure 22:
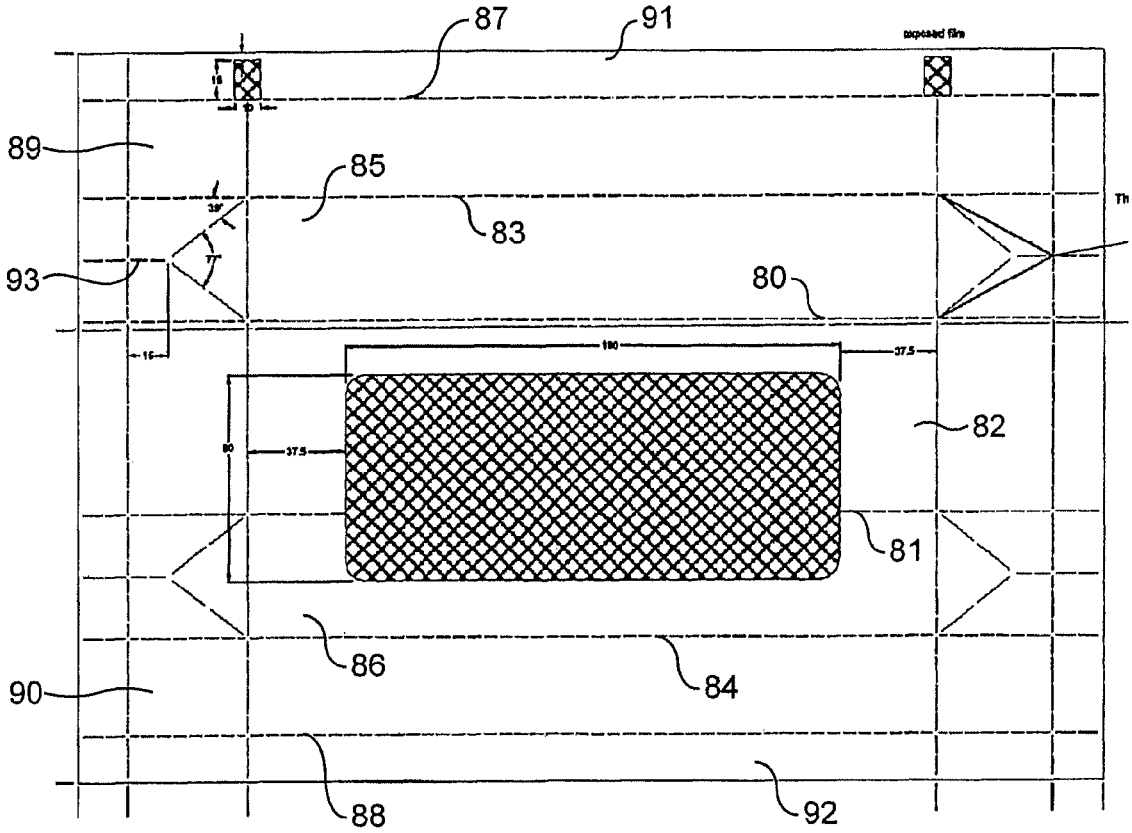
FIGS. 22 to 24 show blanks for an elongate rectangular cross-section container for a baguette or the like and completed containers.
Figure 24:
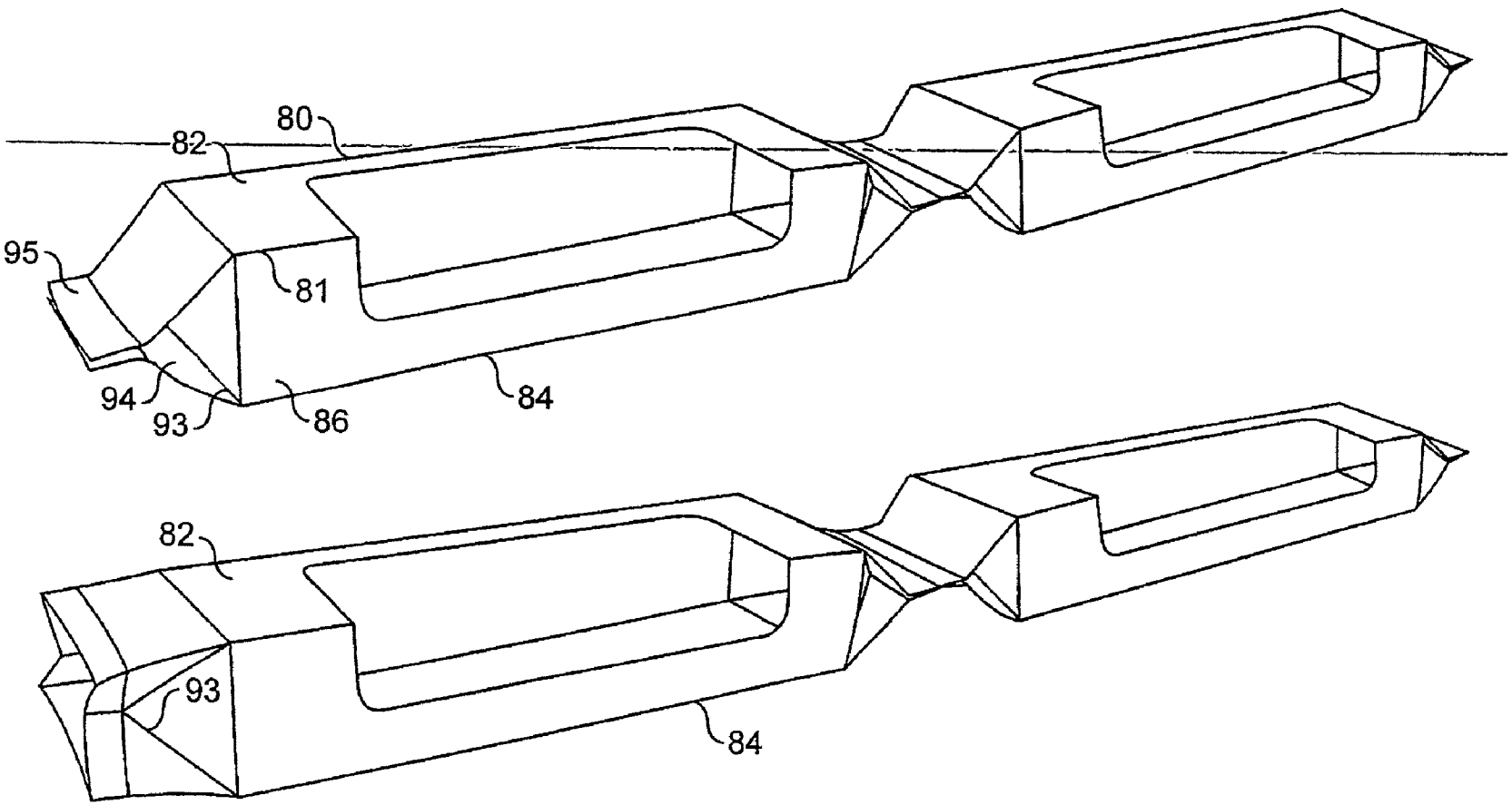

FIGS. 22 and 24 illustrate an elongate rectangular cross-section container for a baguette or similar elongate food item and the blank from which the container is formed.

The web from which the pack is formed is created as described above by printing any matter required on the web and then creating fold lines by scoring or skip cutting the web and cutting fully through the web to form the window. The web is subsequently laminated to a sheet of plastics film so that wide areas of the web can be heat-sealed together and so that the window through the web is covered by the film.

Figure 23:
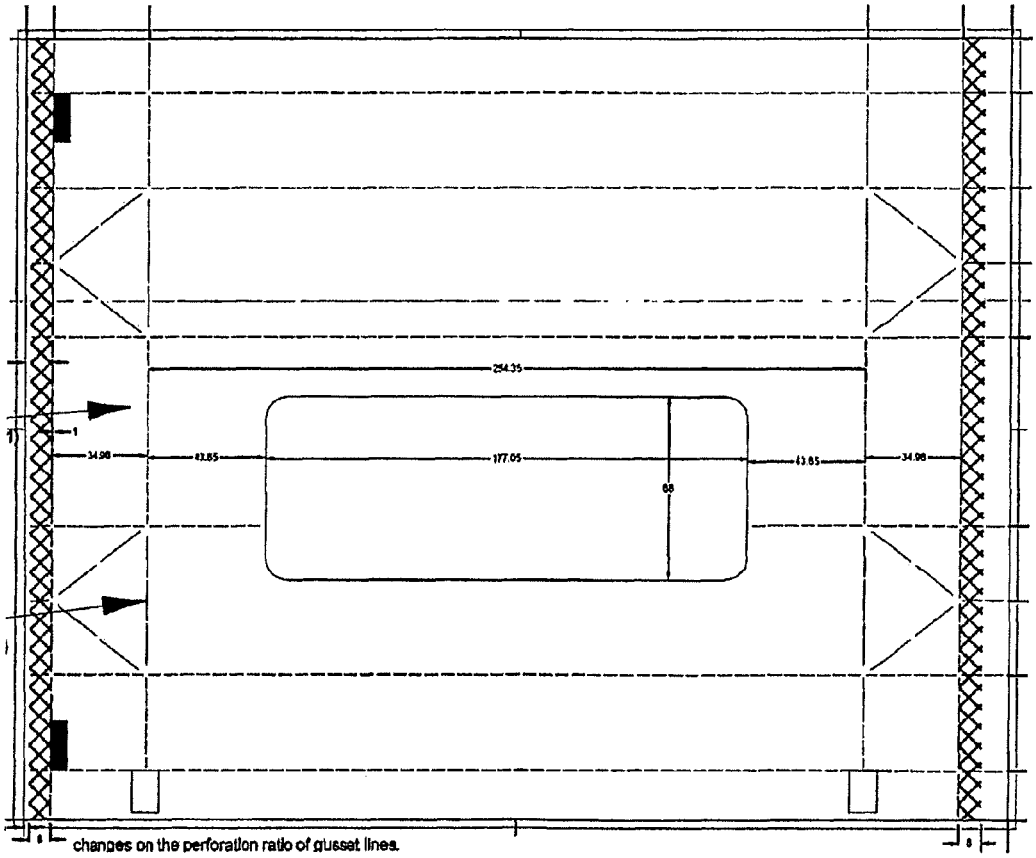

Referring now to FIGS. 22 and 23 of the drawings, the web of paper/soft card is formed with a pair of parallel lines 80, 81 to define the top surface 82 for the container, with parallel fold lines 83, 84 to define side walls 85 and 86 for the container and with parallel cut lines 87 and 88 to define the bottom wall of the container 89, 90 with out-turned tabs 91, 92 which are heat-sealed together as described below to create the container a food item.

The end regions of the side walls 85 and 86 of the container have Y shaped lines of cut indicated at 93 which enable the ends to fold in to form gussets adjacent the ends of the pack and to allow the top and bottom walls 82 and 89/90 to be brought together to be heat-sealed together to close the ends of the pack.

The web of laminated material is fed to a wrapping/filling machine in which a former is used to create the rectangular cross-section of the web around the baguette or other elongate food item to be packaged. The flanges 91, 92 on the underside of the container are heat-sealed together, and tooling presses the regions of the side walls 85, 86 inwardly to form the gussets indicated at 94 in FIG. 24 in the end portions of the containers.

It will be appreciated that many modifications may be made to the above described embodiments without departing from the scope of the invention. The method of forming the laminate web from which the packs are treated is applicable to many other shapes, styles and forms of pack. By forming the fold lines and any required lines of cut in the web of paper/card prior to laminating to the film, the cutting operation is greatly simplified since there is no risk of severing the film. By applying the film to the whole of the surface of the web, an impervious barrier is created on the inside of the pack which also enables areas of the blank to be heat-sealed together to form the pack. The arrangement therefore lends itself to automated production of a wide variety of packs for food items and other products.

As indicated above, the material for the film to be laminated to the paper/card may comprise a number of substances such as polylactic acid (PLA), cellulose, polypropylene, polyethylene and polyethylene terephthalate (PET). These materials may optionally be provided with any of the following: anti-mist coatings, gas and/or moisture barriers such as ethylene vinyl alcohol (EVOH), polyvinylidene dichlorisel (PVdC), nylon peelable coatings.

The invention claimed is:

1. A method of preparing a web of flexible material for production of receptacles for packaging, the method comprising the steps of:

feeding a web of flexible material past a succession of stations while carrying out operations on the web, including defining blanks for receptacles having walls and tabs, including flanges, by creating fold lines in the web by at least partially cutting or scoring through the web of flexible material, and preforming lines of cut in the blank to define notches between adjacent flanges, then, laminating a film of heat-sealable plastics material to a face of the web of the flexible material to provide a heat-sealable surface for bonding tabs of each blank together to form seams between adjacent walls, and bridging the adjacent notches by laminating the film of heat-sealable plastics material to the web, whereby the blanks, when severed from the web, can be erected to form receptacles having openings to receive items to be packaged, with the out-turned flanges extending along sides of the opening into the receptacle being heat-sealed through the film laminated to the surface of the blank to a lid, thereby to close the receptacle; wherein laminating the film of heat-sealable plastics material to the web and bridging the notches defined between the adjacent flanges serve to assist in forming a hermetic seal for the receptacle between the flanges.

2. A method as claimed in claim 1, wherein the method comprises the further step of defining the fold lines by continuous cut lines extending partway through the thickness of the web.

3. A method as claimed in claim 1, wherein the method comprises the further step of defining the fold lines by discontinuous or skip cut lines extending fully through the web.

4. A method as claimed in claim 1, wherein the method comprises the further step, prior to said laminating step, of cutting out a portion of at least one wall of each blank delineated in the web to form a window for the receptacle to be formed from the blank, and subsequently laminating the film of heat-sealable plastics to the web of flexible material and extending over the window.

5. A method as claimed in claim 1, wherein the method comprises the further step of forming the laminated web into a roll for subsequent processing into receptacles.

6. A method as claimed in claim 1, and in the case where each blank delineated on the web has a centre line about which it is symmetrical with respective walls, part walls and tabs being disposed on either side of the centre line, wherein the laminated web is folded about the centre line of the blanks to bring the surfaces of the plastic material including the tabs on either side of the centre line together and the tabs are heat-sealed together to form the seams in the blank which allow the blank to be erected to form a receptacle with the seams located externally of the receptacle.

7. A method as claimed in claim 6, wherein the method comprises the further step of cutting the laminated web round the folded profile of each blank to separate the blanks from the web for subsequent erection.

8. A method as claimed in claim 1, wherein each blank delineated on the web has triangular side walls and quadrilateral shaped end walls to enable a prism shaped receptacle to be erected from the blank.

9. A method as claimed in claim 8, wherein each blank includes isosceles triangular side walls having an included angle in the region of 90°, a pair of similar quadrilateral shaped end walls between the sides of the triangle of similar length and a further quadrilateral shaped end wall extending along the base of one of the triangular walls to provide a lid for the receptacle.

10. A method as claimed in claim 9, wherein the pair of end walls of the blank each have a tab extending along an edge of the end wall to be heat-sealed together to form an external seam between the end walls.

11. A method as claimed in claim 9 or claim 10, wherein one of the triangular side walls is formed in the blank in two parts, each part having a tab extending an edge thereof to be heat-sealed together to complete the wall with an external seam in the completed blank.

12. A method as claimed in claim 11, wherein said first triangular wall of the blank delineated on the web is an isosceles triangle having an included angle of 90° or thereabouts, the triangle being aligned on the web with a centre line which bisects said included angle extending lengthwise of the web, the base of the triangle having a quadrilateral end wall connected by a fold line thereto through which said centre line passes to provide a lid for the receptacle and the further end walls are connected by fold lines to the sides of the triangle, the half walls which make up the second triangular wall being located on the sides of the end walls opposite the first triangular wall and the further end walls and half walls having tabs at their adjacent edges which can be heat-sealed together to form out-turned seams which support the walls when the receptacle is erected from the blanks.

13. A method as claimed in claim 12, wherein the method further comprises the step of defining blanks delineated on the web to include: a lid hinged to a wall of the blank, the walls of the blank adjacent the ends of the lid having flanges being hinged to the walls, and the ends of the lid having flanges hinged to the lid and to the flanges on the respective end walls to fold inwardly when the lid is folded over the opening to the receptacle.

14. A method as claimed in claim 12, wherein the method, and in the case where one wall of the blank is formed by two part walls secured together by tabs on the part walls to form an out-turned flange on the wall, comprises the further step of defining the flanges on said part walls with cutaway to enable the flanges to form a flush surface with which the lid of the container can be sealed.

15. A method as claimed claim 1, wherein the method comprises the further step of defining the blank to include a lid hinged to one wall of the blank on one side of the opening into the receptacle and preforming lines of cut in the web to provide notches between the lid and the flanges adjacent the lid, and bridging the lines of cut by laminating the film of heat-sealable plastics to the web, thereby to assist in forming a hermetic seal for the receptacle between the lid and the flanges.

16. The method as claimed in claim 1, wherein said method comprises the further step of forming V-shaped notches in the blank.

17. The method as claimed in claim 1, wherein the web of flexible material is a web of heavy paper or soft card.

18. A method as claimed in claim 1, wherein the blank defined on the web of material comprises a rectangular base having side walls along the edges of the base with flanges along the edges of the side walls to provide a tray when erected.

* * * * *